US005188173A

United States Patent [19]

Richardson et al.

[11] Patent Number: 5,188,173

[45] Date of Patent: Feb. 23, 1993

[54] PRESSURE CONTROL SYSTEM AND CABLE GUIDING DEVICE FOR USE IN DRILLING WELLS

[75] Inventors: David L. Richardson, Gretna; Robert A. Grubba, New Orleans; Timothy P. McLaughlin, Metairie; David B. Parran, New Orleans, all of La.

[73] Assignee: Schlumberger Technology Corporation, Houston, Tex.

[21] Appl. No.: 703,564

[22] Filed: May 21, 1991

[51] Int. Cl.[5] ..... E21B 19/08

[52] U.S. Cl. ..... 166/77; 166/84

[58] Field of Search ..... 166/75.1, 77, 81, 84

[56] References Cited

U.S. PATENT DOCUMENTS

| | | | |
|---|---|---|---|
| 2,943,682 | 7/1960 | Ingram, Jr. et al. | 166/77 |
| 3,363,880 | 1/1968 | Blagg | 166/75.1 X |
| 3,762,725 | 10/1973 | Taylor | 166/84 X |
| 4,542,787 | 9/1985 | Parker | 166/77 X |

*Primary Examiner*—Terry Lee Melius

*Attorney, Agent, or Firm*—Henry Garrana; John Bouchard; Darcell Walker

[57] ABSTRACT

A cable system for use in completing or logging wells in association with a rig disposed at the surface, comprising:

a pressure control device for counterbalancing the fluid pressure from the well; and a high pressure chamber through which the cable passes; and a cable sheave wheel incorporating the chamber.

15 Claims, 5 Drawing Sheets

70
75
50
73
76
72
77
74
71
66
65
74
78

FIG. 5A
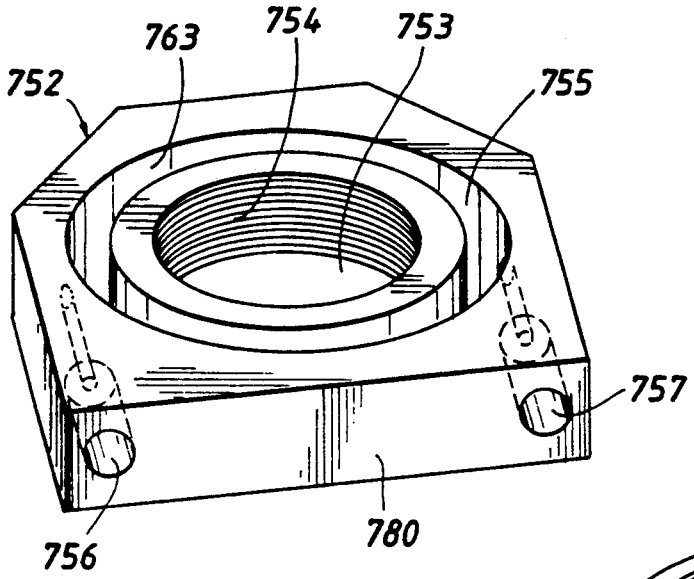
FIG. 5B
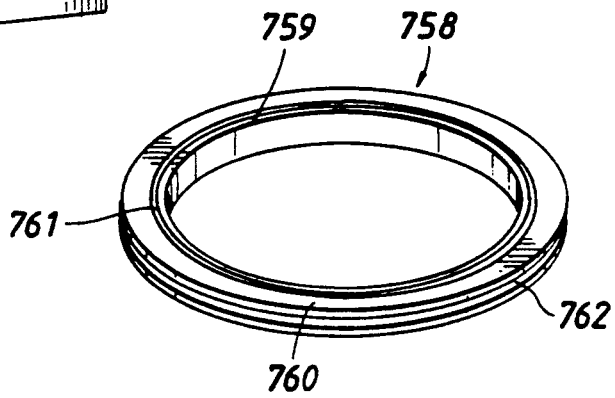
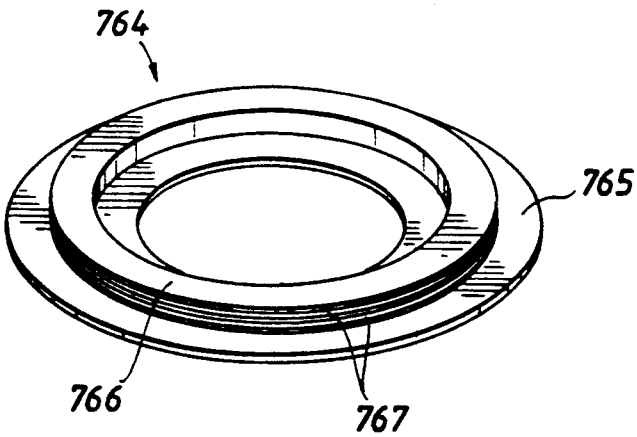
FIG. 5C
FIG. 5D
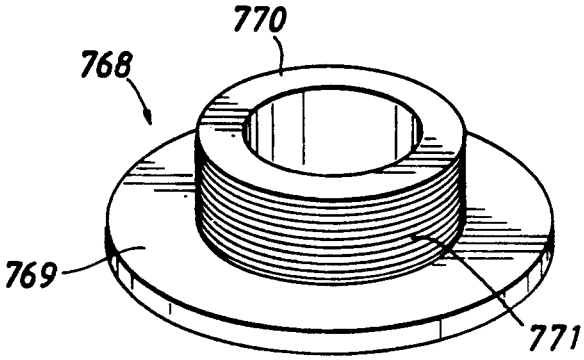

PRESSURE CONTROL SYSTEM AND CABLE GUIDING DEVICE FOR USE IN DRILLING WELLS

BACKGROUND OF THE INVENTION

1. Field of the invention

The present invention relates to a system for controlling the pressure at the well head of a well, and is designed to accommodate logging and completion operations in the well through cable mounted tools.

2. Description of the related art

The capital cost of drilling and evaluating a deep well, for example an oil or natural gas well, is extremely high, and for this reason considerable expense is incurred during those time intervals when drilling or production steps must be interrupted to evaluate the formation. Such evaluation is carried out by lowering in the well a logging sonde or logging tool designed to measure physical parameters representative of the earth formation.

When conducting well-logging operations in a well or borehole, it is necessary to raise and lower the logging tool within the borehole by means of a logging cable. One end of the logging cable is attached to the logging tool via a logging tool connector, and the other end of the logging cable is attached to a winch apparatus which may be disposed on either a suitable truck or an offshore skid unit. It is conventional to pass the logging cable over a plurality of sheave wheels disposed between the winch apparatus and the borehole. Typically, there is an upper sheave wheel attached to the derrick structure rising several feet above the well; the upper sheave deviates the cable at an angle of 180 degrees or so. The cable then engages a lower sheave wheel attached to the derrick structure, above the derrick platform. Moreover, the well is equipped at the surface with a relatively complex pressure control system designed to counterbalance the pressure of the fluid present in the well. The fluid can be either a drilling mud in uncompleted wells, or oil or gas in case of a producing well. A typical pressure control system comprises from the surface to the top: (i) a well head; (ii) a blow out preventer; (iii) a device, usually called a "tool riser", allowing to introduce into the well a logging tool attached to the cable; a tool riser is usually made of several sections of tubes; the last tube is provided at its upper end with a tool head catcher; (iv) a device called a "grease seal" comprising successive pipes, usually called "grease pipes"; the top grease pipe comprises at its end a seal associated with a "cable wiper"; the grease pipes have an internal diameter slightly larger than the cable diameter. High viscosity grease is pumped under high pressure in the annulus between the cable and the internal wall of the grease pipes. While the cable is free to move inside the pipe, the pressurized grease acts as an effective seal against well pressure.

The pressure control system and cable guiding device of the prior art, as hereabove described, present several drawbacks.

All the elements above referred to are disposed end-to-end and thus lead to a substantial height. By way of example, the height of the different elements ar of the following order of magnitude: well head: 3 feet; tool riser: 30 feet; grease seal pipes: 12 feet. The total height of the pressure control system is on the order of 45 feet above ground. Furthermore, an additional foot is required between the top of the pressure control system and the upper sheave wheel which itself measures two feet in height. The total clearance from ground to the top of the sheave is usually around 48 feet. This by itself makes the erection, operation and maintenance of the whole structure complicated, especially when using a crane. Furthermore, on offshore drilling units, the height has such a detrimental effect that it can hinder or even prevent the running of logging operations. An offshore unit generally includes a lower platform where are disposed numerous well heads, typically several tens. Each well head is associated with a well susceptible to be operated from the offshore unit. An upper platform supports the operating set-up including the drilling rig and the personnel and functional facilities. The upper platform is made of a solid floor provided with holes above each well. The elevation between the lower platform and the upper platform is generally about 40 feet or less, while the pressure control system and cable guiding device needed for logging operations are about 48–50 feet high, as already stated. It is impossible to reduce the height of the pressure control system without putting in jeopardy the operation of the same. As a matter of fact, the tool riser height is dependent on the logging tool length. Also, the grease pipes must have a minimum length for given grease viscosity, grease pressure, and pipe internal diameter, so as to be able to balance the well pressure. As a result, no logging operation is possible due to the presence of the drilling rig and the associated upper platform. Since removing those is time consuming and very costly, the logging operations are carried out after all the drilling operations are finished and the rig and platform are removed. This situation, as it can be easily understood, severely limits the opportunities to run logging operations in wells on an offshore site.

Another drawback of prior art devices relates to grease expelled during cable movement from the wiper at the top of the vertical grease seal pipes. The expelled grease accumulates on the upper sheave, and eventually spreads across the well platform or on the ground or in the sea, as wind catches it. This situation is damaging in two respects. First, grease spread on the work area constitutes a hazard since it increases substantially the risks of slipping and falling. Also grease flying in the wind might land on clothes and, with a more serious consequence, in the eyes. Second, the expelled grease is a source of pollution when falling on the ground or in the sea. There is no satisfactory means available so far to collect efficiently the grease expelled.

Prior art devices show a further disadvantage. Putting in place and removing the tool riser, the sheave and the grease pipes (called "rig-up" and "rig-down" operations) are time consuming due to the necessity of untwisting the cable or realigning the sheave, since the sheave has a tendency to spin when being picked up. This situation becomes detrimental when successive logging operations have to be run.

Finally, in prior art devices, it is relatively difficult to align the sheave with the pressure control device. Any off-centering of the sheave with respect to the pressure control device creates an additional stress on the same which adds to the pressure stress coming from the well.

According to the above, there is a strong need for pressure control systems and cable guiding devices which overcome the above mentioned drawbacks.

OBJECTS OF THE INVENTION

It is an object of the invention to provide a well system disposed at the top of a well, and designed to control the pressure coming from the well and to guide a cable during logging or completion operations, such system showing a reduced height to accommodate various situations and thus increase the number of opportunities to run logging operations.

Another object of the invention is to propose a well system which helps to increase safety and reducing environment concerns, by avoiding the uncontrolled spreading of grease on the platform, the ground or the sea.

A further object of the invention is a well system which allows one to reduce "rig-up" and "rig-down" operations times.

A still further object of the invention is a well system wherein the upper cable sheave is easy to align with the rest of the structure erected above the well.

SUMMARY OF THE INVENTION

The foregoing and other objects are attained in accordance with the invention by a well system for the control of fluid pressure coming from a well and designed to accommodate cable mounted logging operations in the well, comprising:

a well head;

a pressure control device comprising a chamber surrounding the cable and in pressure communication with the well fluid pressure; and means for supporting and deviating the cable and which incorporates at least part of the high pressure chamber.

More precisely, the means for supporting and deviating the cable comprises either a sheave wheel, or alternately, a set of rollers disposed along an arched path.

The well system may further include means for introducing in or removing from the well a logging tool mounted on the cable, those means being disposed between the well head and the pressure control device.

More particularly, the means for introducing/removing the logging tool comprises a set of removable pressure proof tubes disposed end-to-end.

In a preferred embodiment, the pressure control device comprises a pressure proof conduit through which the cable passes and being connected at one end to the well head and at the other end to a grease seal/wiper means, the conduit diameter being slightly larger than the outer diameter of the cable, and the high pressure chamber being defined by the annulus between the conduit wall and the cable, the conduit being disposed at least partly along the perimeter of the sheave in contact with the cable.

Advantageously, the pressure proof conduit comprises a first section disposed along the sheave and connected to the well head and a second section defined by a pipe and connected to the seal/wiper means. In that case, at the free end of the pipe may be disposed a grease collector.

Preferably, the cable sheave wheel deviates the cable at an angle slightly less than 180 degrees, and preferably between 170 and 175 degrees.

The characteristics and advantages of the invention will appear better from the description to follow, given by way of a non limiting example, with reference to the appended drawing in which:

BRIEF DESCRIPTION OF THE DRAWINGS

FIG. 5A, 5B, 5C and 5D show in perspective view the respective elements constituting the cable sheave system according to the invention.

DETAILED DESCRIPTION OF THE INVENTION

Figure 1:
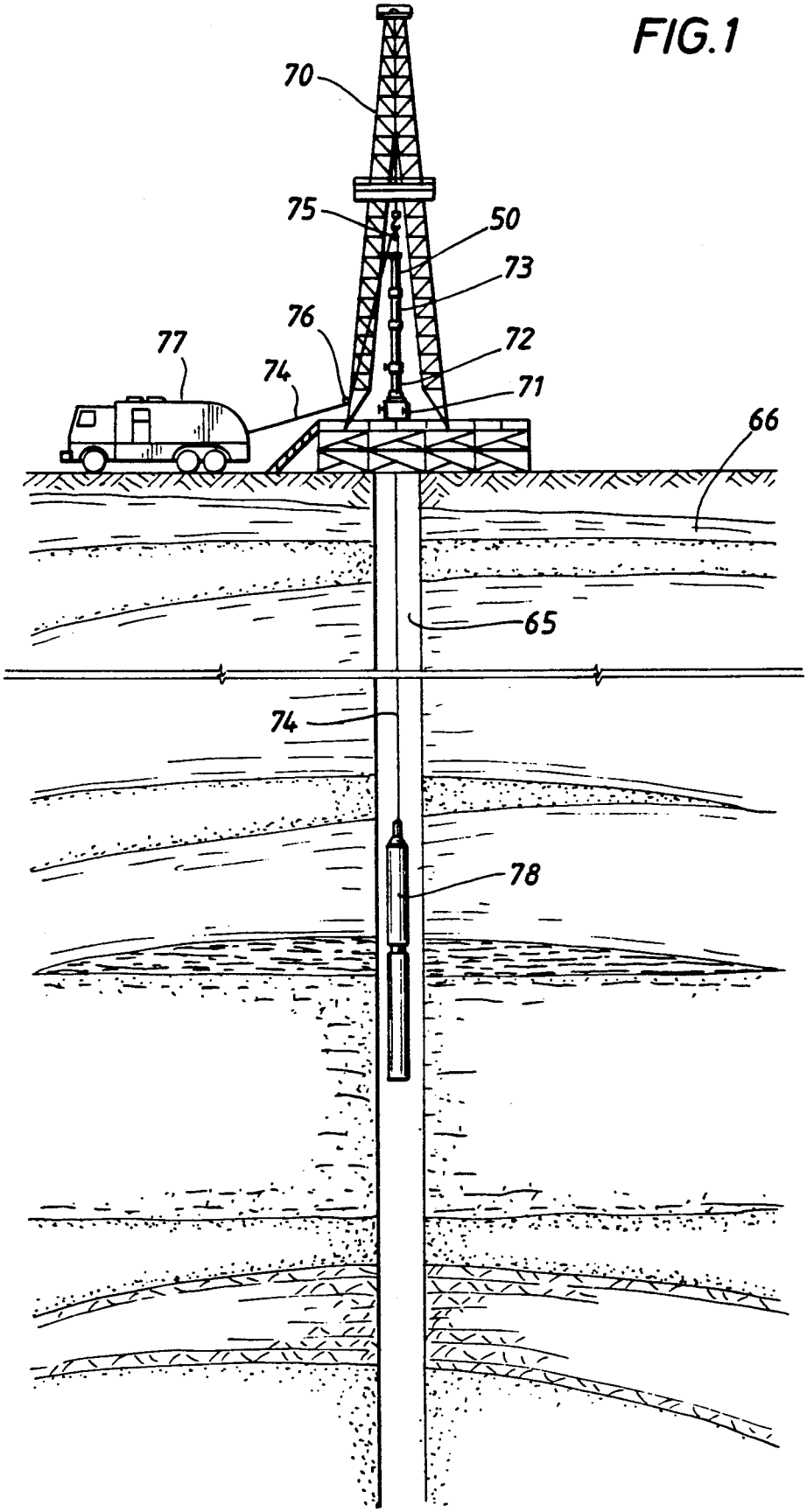
FIG. 1 is a general overview of a well equipped with a rig platform, a pressure control system (of the prior art) and a logging operation unit.

In FIG. 1, a derrick structure 70 is shown above a well 65 traversing earth formations 66. At the surface, above the well 65 are disposed end-to-end, a conventional well head 71, a blowout preventer 72, tool riser 73 and grease seal pipes 50. A conventional well-logging cable 74 (hereafter logging cable) is shown to pass about an upper cable sheave wheel 75 which is secured above the tool riser 73. The cable 74 passes also around a lower sheave wheel 76 which is secured to the derrick structure 70. Cable 74 has one of its ends, beyond lower sheave wheel 76, attached to a conventional winch apparatus (not shown) which may be mounted on a well-logging truck 77. The other end of logging cable 74 is in turn secured to a logging tool 78. Well-logging truck 77 comprises means for operating remotely logging tool 78 and for recording or otherwise processing the data issued from logging tool 78. The latter can be of any known type.

Although the present detailed description refers to logging operations, it has to be borne in mind that the present invention can also be applied to completion or perforating operations.

Figure 2:
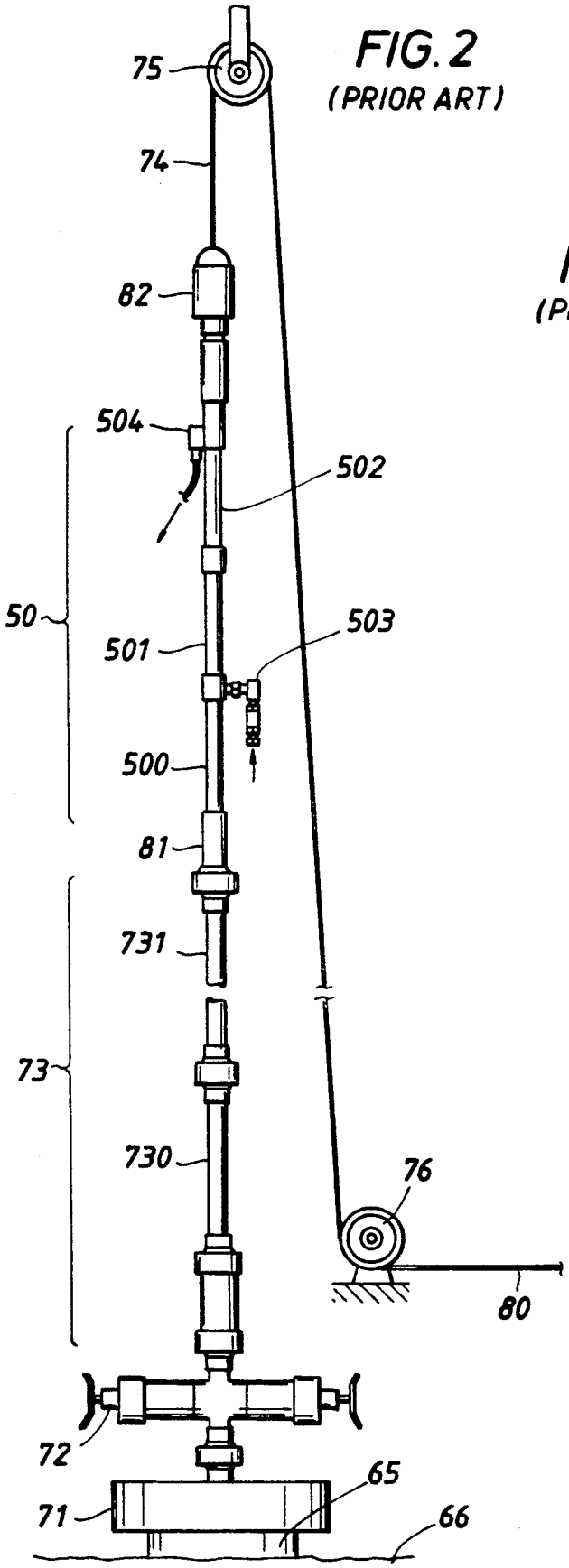
FIG. 2 (PRIOR ART)
FIG. 2 is a side view, at an enlarged scale, of a pressure control system and the cable guiding device of the prior art.
Figure 3:
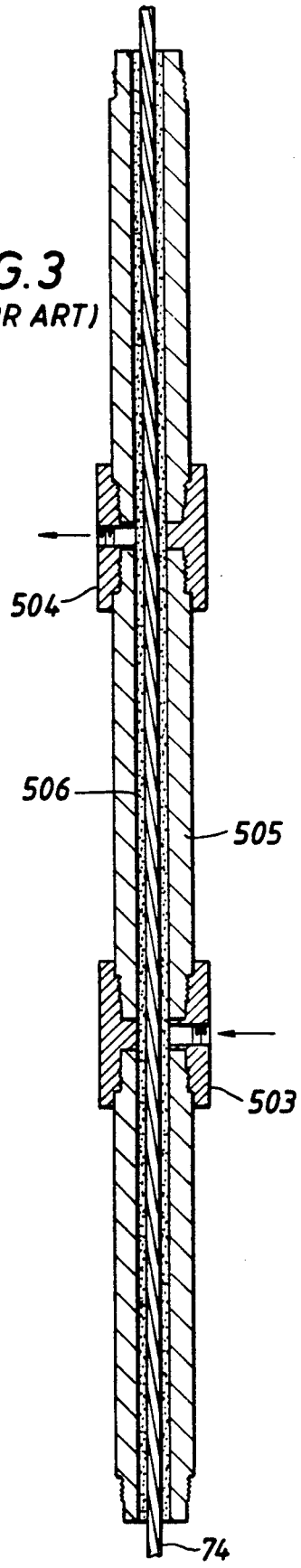
FIG. 3 (PRIOR ART)
FIG. 3 is a schematic cross section of grease flow pipe of the prior art, as being part of the pressure control system.

FIG. 2 is a more detailed view of the well system of the prior art shown on FIG. 1. For the sake of clarity, the derrick and logging truck have not been represented. Above well 65 are disposed successively, from bottom to top: well head 71, blow out preventer 72, tool head catcher 81, grease seal pipes 50 and seal/wiper 82. The cable 74 passes through all the above mentioned elements which are known per se; examples of the same can be found in U.S. Pat. Nos. 3,804,168; 4,480,818 or 4,515,211 which are herein incorporated by reference. Cable 74 passes around upper sheave 75 which supports and deviates the cable at an angle of about 180 degrees. Cable 74 then engages a lower sheave 76 which deviates the cable at a right angle to form a horizontal section 80 which goes to a winch unit (not shown). Upper and lower sheaves 75, 76 are both secured to the derrick in a conventional manner. In the example shown, tool riser 73 comprises two tubes, referenced 730 and 731, and grease seal pipes 50 comprises three pipes 500, 501 and 502. Grass seal pipes 50 are connected via a first connector 503 to a high pressure grease source while grease exits from the pipes via a second connector 504. FIG. 3 is a schematic cross section of a grease seal pipe of the prior art, showing the principle of operation of the same. Pipe 505 has an internal diameter slightly larger than the cable diameter and the annulus between the cable and the pipe internal wall defines a pressure proof chamber 506 which is filled with high pressure grease through connector 503. Grease in excess exits through connector 504. At the top of pipe 505 is disposed a pressure seal (not shown for the sake of clarity) which could be implemented in the form of seal/wiper 82 of FIG. 2. Turning back to FIG. 2, tool head catcher 81 is designed to engage the logging tool head so that the logging tool is maintained as it is detached from the cable if the logging run is terminated accidentally. Seal/wiper 82 has a dual function, i.e. to seal the end of the grease seal pipes and to wipe grease off cable 74 as it moves up and down.

FIG. 2 pictures the drawbacks of the prior art systems as already stated. The whole well system erects at a substantial height above ground with the consequences hereabove referred to. Also, one understands the difficulty of collecting grease which accumulates at the upper sheave 75 as well as the hardship of aligning the upper sheave 75 with the system erected above ground.

Figure 4:
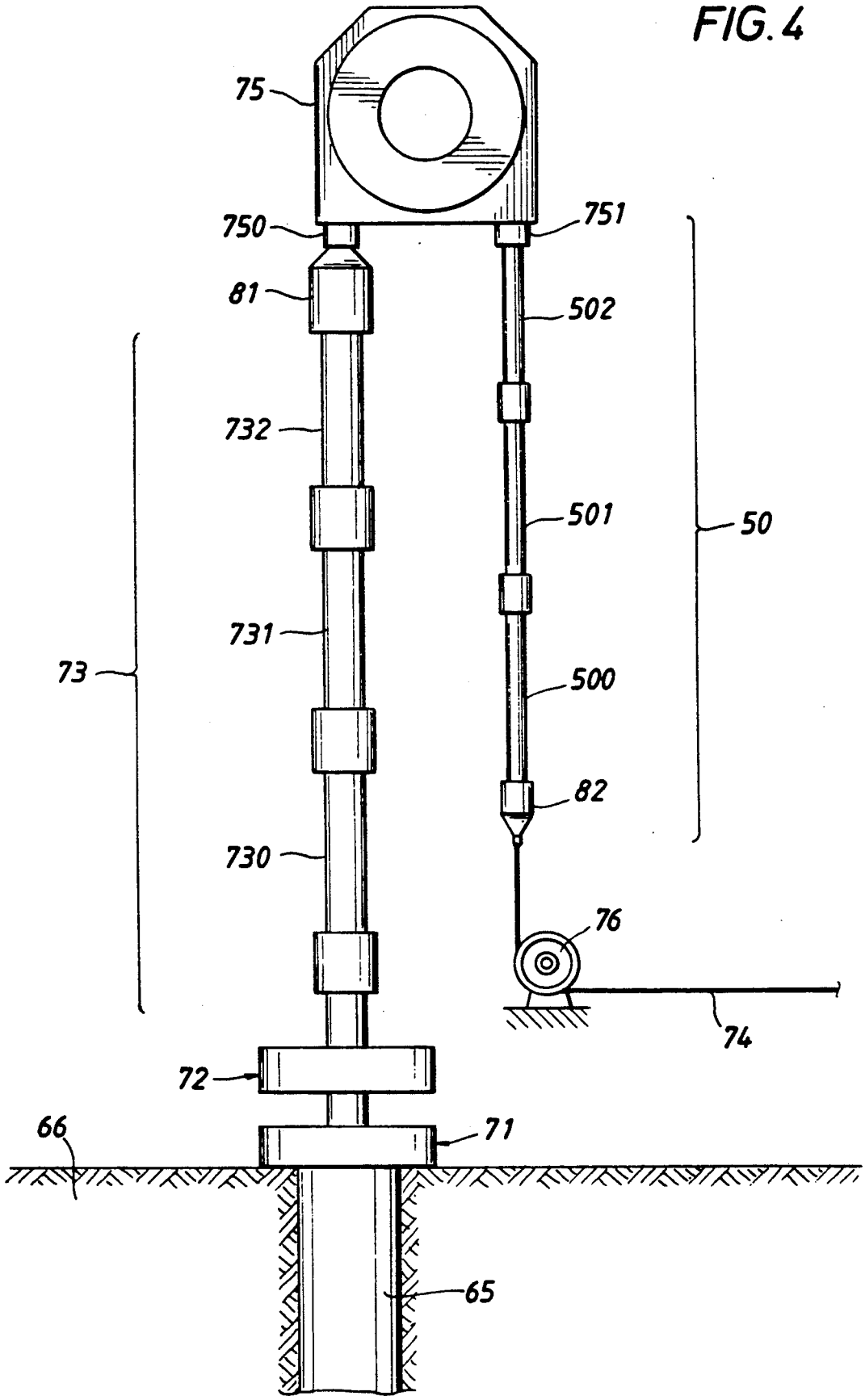
FIG. 4 shows a schematic side view of the pressure control system and the cable guiding device according to the invention.

FIG. 4 shows schematically a side view of an example of a well system according to the invention. The elements in FIG. 4 which are similar to those in FIG. 2 bear the same reference, for the sake of clarity. Also, the respective elements shown on FIG. 4 are not drawn to scale. Above the well are disposed, from the surface to the top: a well head 71, a blow out preventer 72, a tool riser 73, a tool head catcher 81, an upper sheave system 75, grease seal pipes 50, a seal/wiper 82 and a lower sheave 76. All these elements, except the upper sheave system 75 and its associated connection means, may be the same as or similar to those of the prior art hereabove described in connection with FIGS. 1-3. Tool riser 73 comprises tubes 730, 731 and 732, while grease seal pipes 50 comprise pipes 500, 501 and 502. The upper sheave system is attached in a conventional manner to the derrick (not shown). For the sake of brevity, the upper sheave system 75 will be referred to as "sheave system" or "sheave".

According to the invention, the upper sheave system 75 is submitted to fluid pressure and is linked to tool head catcher 81 by a first connector 750 and to grease seal pipes 502 by a second connector 751.

Before describing in more details the upper sheave system of the invention, one can get from FIG. 4 a good comprehension of the advantages of the invention over the prior art. The sheave 75 being disposed between the tool riser 73 and grease pipes 50 allow the latter to be in reverse position, i.e. facing down. A comparison between FIG. 4 and FIG. 2 (prior art) shows the reduction in height provided by the sheave of the invention. Also, the grease expelled at the end of the grease pipes at the seal/wiper 82 can be easily collected, e.g. by using a simple bucket. Furthermore, the alignment between the upper sheave 75 and the tool riser 73 is made simple.

The sheave according to the invention will now be described with more details, in connection with FIGS. 5A-5D and 6A-6D showing an example of implementation of the upper sheave system 75.

Figure 6D:
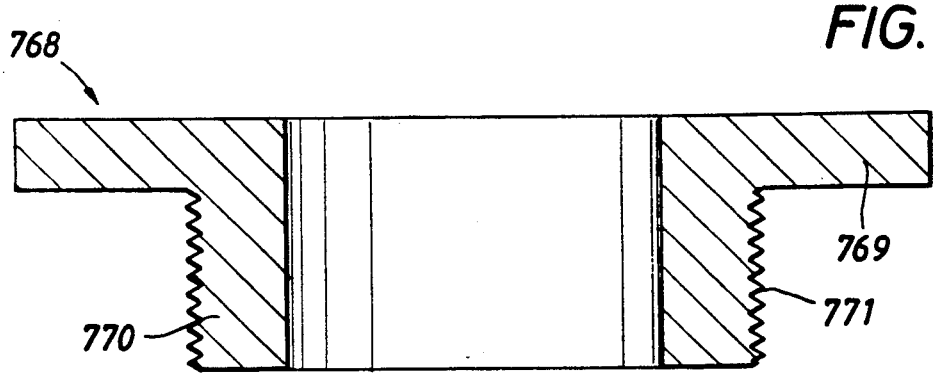
FIG. 6A, 6B, 6C and 6D are cross section views of the respective elements of FIG. 5A–5D.
Figure 6C:
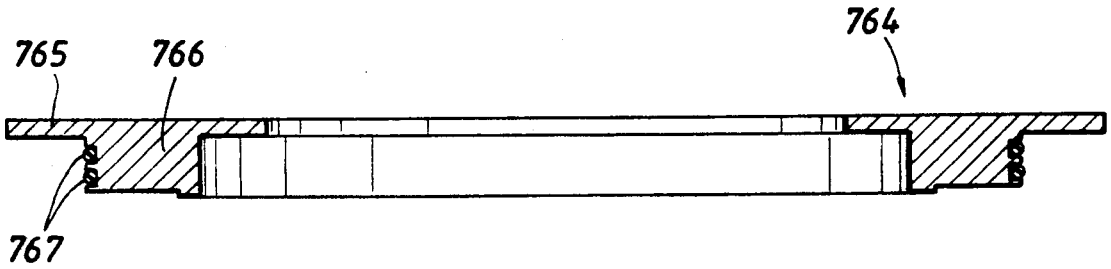
Figure 6B:
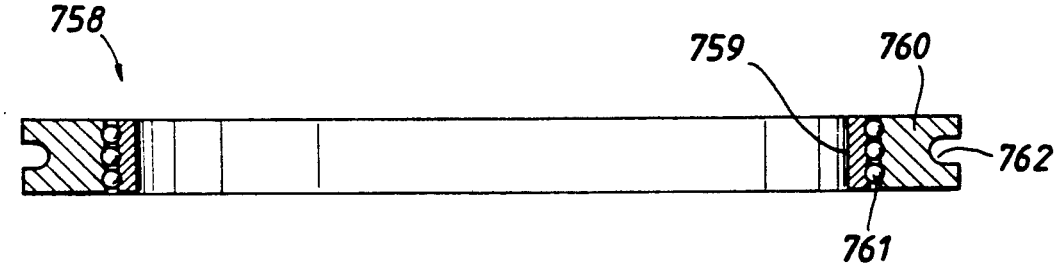
Figure 6A:
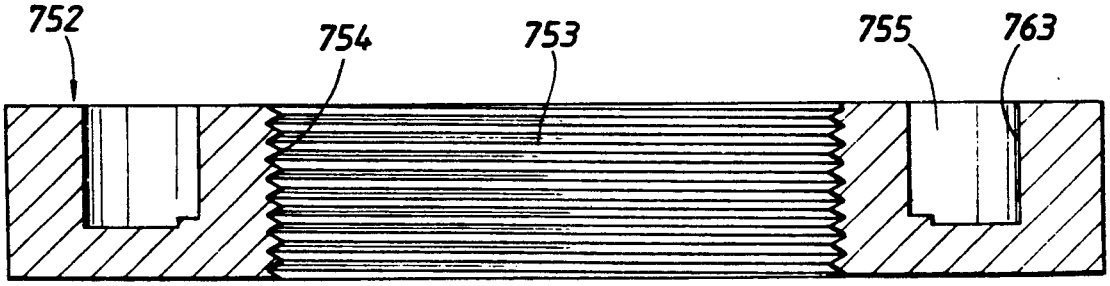

The sheave system 75 is made of different elements, each of which is shown in a perspective view on the respective FIGS. 5A-5D. The same elements are shown in cross section on the respective FIGS. 6A-6D. FIGS. 5A and 6A show a block 752 in the form of a parallelepiped shaped plate having two parallel main sides. A cylindrical hole 753 disposed in a centered position, opens out on the two parallel main sides. The cylindrical wall defining hole 753 is provided with a screw thread 754. Block 752 further comprises an annular cavity 755 which is coaxially disposed with respect to central hole 753 and which opens out on one main side. Two cylindrical bores 756 and 757, parallel to each other, open out at one end onto a transverse side 780 of the block 752 perpendicular to the two main parallel sides. Bores 756 and 757 open out at their other end into the annular cavity 755. The axes of the bores 756 and 757 are substantially tangent to the outer wall of the cavity 755. Each bore 756, 757 is dimensioned to accommodate respectively (see FIG. 4) grease pipe 502 and the top end of tool head catcher 81. The end of bores 756 and 757 opening out into the cavity 755 shows a restricted diameter slightly larger than the diameter of the cable.

The sheave system comprises a further element 758 (FIGS. 5B and 6B) designed to support and guide the cable. Cable guiding element 758 is to be disposed in the annular cavity 755, and comprises an inner part 759 which bears against the cavity wall and an outer part 760 which freely rotates thanks to conventional ball bearings 761. The periphery of the rotating part 760 is provided with a groove 762 the size of which is such that, once the annular cable guide 758 is disposed inside the cavity 755 of block 752, the groove 762 defines with the outer wall 763 of the cavity 755 an internal annular space complementary to the cable. According to an alternate embodiment, the cable guiding element may comprise a set of rollers disposed along a U-shaped path inside cavity 755.

A disc-shaped cover 764 (FIG. 5C-6C) comprising a disc 765 is designed to cover the open section of cavity 755. On one side of the disc 765 is mounted an annular body 766 which fits in the cavity 755. The outer wall of body 766 comprises seal rings 767 designed to bear against the outer wall of cavity 755.

As can be understood from the above, cavity 755 defines an annular chamber submitted to high fluid pressure from the grease pipes 501-503 and from the well fluid pressure through the tool riser 73 (see FIG. 4).

In order to withstand the pressure inside the cavity 755, a cap 768 (see FIGS. 5D and 6D) is disposed on the disc cover 764 and threaded on block 752. Cap 768 comprises a cylindrical element 770 provided with a screw thread 771 on its outer wall and on top of which is mounted a thick annular disc 769. Threaded element 770 is complementary to central hole 753 in block 752. Screw thread 771 is complementary as well to screw thread 754 provided on the block 752 (FIGS. 5A and 6A). Alternately, bolts uniformly disposed on the periphery of cap 768 can be used to secure cap 768 on block 752, instead of threads 771 and 754.

By way of illustrating example, herebelow are given approximate dimensions (in inches) of the embodiment of the sheave system described in connection with FIGS. 5 and 6:

| | | |
|---|---|---|
| Block 752 | outer diameter | 16 |
| | inner diameter | 9 |
| | cavity width/depth | 2/2 |
| Sheave & cable guide | | |
| Disc cover | outer diameter | 17 |
| | height | 1 |

-continued

| | | |
|---|---|---|
| Threaded cap | outer diameter | 15 |
| | inner diameter | 6 |
| | height | 4 |

What is claimed is:

1. A pressurized sheave wheel for use in a well system for the control of fluid pressure coming from a well and for accommodating cable-connected logging or completion operations in said well, comprising:

a housing having a central axial opening therethrough;

an annular chamber in said housing coaxial with and surrounding said central opening;

a first conduit through said housing, said first conduit opening into said annular chamber, said first conduit being essentially tangential to said annular chamber;

a second conduit through said housing, said second conduit opening into said annular chamber, said second conduit entering said housing from the same face as said first conduit, being diametrically opposed thereto and essentially tangential to said annular chamber;

bearing means located within said annular chamber and coaxial therewith, said bearing means comprising a circular housing including a groove on the periphery thereof for receiving and guiding a cable therearound, said groove being larger than said cable to be received therein;

sealing means within said annular chamber for sealing said annular chamber;

cap means mating with said central axial opening in said housing and secured to said housing for retaining said bearing means and said sealing means within said annular chamber; and means for pressurizing a volume of said annular chamber wherein said pressurized volume is defined by the annulus between said cable and said groove.

2. The apparatus of claim 1 wherein said first conduit is connected to a first pressure-proof pipe which is connected to a well head and said second conduit is connected to a second pressure-proof pipe which terminates in a seal/wiper means.

3. The apparatus of claim 2 wherein said cable is threaded through said annular chamber through said first and second conduits while being guided by said groove, and further through said first and second pressure-proof pipes.

4. The apparatus of claim 3 wherein said first pressure-proof pipe is a tool riser.

5. The apparatus of claim 4 wherein said second pressure-proof pipe is a grease pipe.

6. A pressurized sheave wheel for use in a well system for the control of fluid pressure coming from a well and for accommodating cable-connected logging or completion operations in said well, comprising:

a housing having an axis;

an annular chamber in said housing displaced from and coaxial with said axis;

a first conduit through said housing, said first conduit opening into said annular chamber said first conduit being essentially tangential to said annular chamber;

a second conduit through said housing, said second conduit opening into said annular chamber, said second conduit entering said housing from the same face as said first conduit, being diametrically opposed thereto and essentially tangential to said annular chamber;

bearing means located within said annular chamber and coaxial therewith, said bearing means comprising a circular housing including a groove on the periphery thereof encircling said bearing means for receiving and guiding a cable therearound between said first and second conduits, said groove being larger than said cable to be received therein;

sealing means for sealing said annular chamber;

cap means secured to said housing for retaining said bearing means and said sealing means; and means for pressurizing a volume of said annular chamber wherein said pressurized volume is defined by the annulus between said cable and said groove.

7. The apparatus of claim 6 wherein said first conduit is connected to a first pressure-proof pipe which is connected to a well head and said second conduit is connected to a second pressure-proof pipe which terminates in a seal/wiper means.

8. The apparatus of claim 7 wherein said cable is threaded through said annular chamber through said first and second conduits while being guided by said groove, and further through said first and second pressure-proof pipes.

9. The apparatus of claim 8 wherein said first pressure-proof pipe is a tool riser.

10. The apparatus of claim 9 wherein said second pressure-proof pipe is a grease pipe.

11. The apparatus of claim 6 wherein said first conduit is adapted to be connected to a first pressure-proof pipe and said second conduit is adapted to be connected to a second pressure-proof pipe.

12. The apparatus of claim 11 wherein said first pressure-proof pipe is connected to a well head and said second pressure-proof pipe terminates in a seal/wiper means.

13. The apparatus of claim 11 wherein said cable is threaded through said annular chamber through said first and second conduits while being guided by said groove, and further through said first and second pressure-proof pipes.

14. The apparatus of claim 13 wherein said first pressure-proof pipe is a tool riser.

15. The apparatus of claim 13 wherein said second pressure-proof pipe is a grease pipe.

* * * * *